US007878687B2

(12) United States Patent
Chen

(10) Patent No.: US 7,878,687 B2
(45) Date of Patent: Feb. 1, 2011

(54) LIGHT-EMITTING DIODE ILLUMINATING EQUIPMENT

(75) Inventor: Jen-Shyan Chen, Hsinchu (TW)

(73) Assignee: Neobulb Technologies, Inc. (BN)

( * ) Notice: Subject to any disclaimer, the term of this patent is extended or adjusted under 35 U.S.C. 154(b) by 334 days.

(21) Appl. No.: 12/068,703

(22) Filed: Feb. 11, 2008

(65) Prior Publication Data

US 2008/0192478 A1 Aug. 14, 2008

(30) Foreign Application Priority Data

Feb. 14, 2007 (TW) ..... 96105423 A

(51) Int. Cl.
*F21V 29/00* (2006.01)

(52) U.S. Cl. ..... 362/294; 362/249.02; 362/373; 362/240

(58) Field of Classification Search ..... 362/555, 362/550, 559, 97.3, 97.1, 168, 169, 184, 362/185, 218, 227, 230, 231, 240, 249.02, 362/268, 310, 421
See application file for complete search history.

(56) References Cited

U.S. PATENT DOCUMENTS

| | | | | |
|---|---|---|---|---|
| 4,729,076 | A * | 3/1988 | Masami et al. | 362/235 |
| 5,803,579 | A | 9/1998 | Turnbull | |
| 6,850,001 | B2 | 2/2005 | Takekuma | |
| 7,338,186 | B1 * | 3/2008 | Wu et al. | 362/294 |
| 7,420,811 | B2 * | 9/2008 | Chan | 361/709 |
| 2003/0137838 | A1 * | 7/2003 | Rizkin et al. | 362/240 |
| 2003/0214803 | A1 | 11/2003 | Ono | |
| 2005/0231983 | A1 | 10/2005 | Dahm | |
| 2006/0056169 | A1 * | 3/2006 | Lodhie et al. | 362/97 |

(Continued)

FOREIGN PATENT DOCUMENTS

| | | |
|---|---|---|
| JP | 2002-299700 | 10/2002 |

(Continued)

OTHER PUBLICATIONS

Office Action in Related TW Patent Application dated Jun. 4, 2010.

(Continued)

*Primary Examiner*—Sandra L O Shea
*Assistant Examiner*—Danielle Allen
(74) *Attorney, Agent, or Firm*—Thomas, Kayden, Horstemeyer & Risley, LLP.

(57) ABSTRACT

The invention discloses a light-emitting diode illuminating equipment, including a heat-dissipating plate device, a plurality of heat-conducting devices, a plurality of diode light-emitting apparatuses, a plurality of optical devices, and a hollow barrel. The hollow barrel is engaged to the heat-dissipating plate device to form a space for accommodating the heat-conducting devices, the diode light-emitting apparatuses, and the optical devices. Each of the diode light-emitting apparatuses corresponds to one of the heat-conducting devices. Each of the optical devices corresponds to at least one of the diode light-emitting apparatuses and modulates a light pattern of the corresponding diode light-emitting apparatus. In an embodiment, each of the optical devices includes a cat's-eye-like lens. The cat's-eye-like lens includes a surface, where a groove is formed along an ellipse minor axis of the lens, such that the light transmitted through the lens can form a light pattern for a specific request.

26 Claims, 9 Drawing Sheets

U.S. PATENT DOCUMENTS

| | | | | |
|---|---|---|---|---|
| 2006/0250803 | A1* | 11/2006 | Chen | 362/373 |
| 2008/0062691 | A1* | 3/2008 | Villard et al. | 362/252 |

FOREIGN PATENT DOCUMENTS

| | | |
|---|---|---|
| JP | 2004-199891 | 7/2004 |
| TW | 286464 | 1/2006 |
| TW | 303333 | 12/2006 |

OTHER PUBLICATIONS

English Abstract of TW-M286464. Pub Date of TW-M286464 Jan. 21, 2006.

English Abstract of TW-M303333. Pub Date of TW-M303333 Dec. 21, 2006.

Office Action in related Taiwan Patent Application dated Feb. 2, 2010.

English Abstract of JP2002-299700.

English Abstract of JP2004-199891.

Office Action in related Korean Patent Application No. 10-2008-7022514 mailed May 24, 2010.

* cited by examiner

LIGHT-EMITTING DIODE ILLUMINATING EQUIPMENT

BACKGROUND OF THE INVENTION

1. Field of the Invention

This present invention relates to a light-emitting diode illuminating equipment, and more particularly relates to a light-emitting diode illuminating equipment with a secondary optics device for generating a specific light pattern.

2. Description of the Prior Art

A light-emitting diode (LED) has advantages of power saving, vibration resistance, fast response, production ability, and so on, so the illuminating equipment with light sources of LEDs is currently being studied and developed. Please refer to FIGS. 1A and 1B. FIG. 1A is a front view of an illuminating equipment with a plurality of LEDs arranged in rows. FIG. 1B is a cross section along the line X-X in FIG. 1A. As shown in FIGS. 1A and 1B, the illuminating equipment gains higher brightness by arranging the LEDs in rows, and each of the LEDs corresponds to a light cup which is used to reflect the light emitted from the corresponding LED so that the light could be concentrated to gain higher brightness. However, by the method, the light could only be concentrated at the same direction and could not generate a specific light pattern for a specific application, so the illuminating function is limited.

Accordingly, there is a need to provide a light-emitting diode illuminating equipment capable of providing a specific light pattern, so as to solve the problems mentioned above.

SUMMARY OF THE INVENTION

A scope of the invention is to provide a light-emitting diode illuminating equipment.

Another scope of the invention is to provide a light-emitting diode illuminating equipment with a secondary optics device for generating a specific light pattern.

According to a preferred embodiment, a light-emitting diode illuminating equipment of the invention includes a heat-dissipating plate device, M heat-conducting devices, N diode light-emitting apparatuses, P optical devices, a hollow barrel, and a transparent shield, wherein M, N, and P are natural numbers, N is larger or equal to M, and P is smaller or equal to N. The heat-dissipating plate device includes a first surface and a second surface opposite to the first surface. A plurality of heat-dissipating fins extends from the second surface. Each of the heat-conducting devices includes a first portion and a second portion extending from the first portion and including a flat end. Each of the diode light-emitting apparatuses corresponds to one of the M heat-conducting devices. Each of the diode light-emitting apparatuses is disposed on the flat end of the corresponding heat-conducting device and converts an electric energy into a light. Because N is larger or equal to M, there is at least one of the diode light-emitting apparatuses disposed on the flat end of one of the heat-conducting devices.

Each of the optical devices corresponds to at least one of the diode light-emitting apparatuses for modulating the light pattern of the corresponding diode light-emitting apparatus. The hollow barrel includes a first circumference and a second circumference. The hollow barrel is engaged through the first circumference to the heat-dissipating plate device to expose the heat-dissipating fins to the air and to form a space for accommodating the heat-conducting devices and the diode light-emitting apparatuses. The transparent shield is engaged to the second circumference of the hollow barrel.

According to the preferred embodiment, the light-emitting diode illuminating equipment further includes a partition plate device which is disposed in the hollow barrel to divide the space into a first room and a second room. The partition plate device thereon forms Q holes, wherein Q is a natural number, and Q is smaller or equal to N. Each of the diode light-emitting apparatuses corresponds to one of the holes. Because Q is smaller or equal to N, one of the holes corresponds to at least one of the diode light-emitting apparatuses.

Furthermore, each of the optical devices includes a support and a lens. The support is detachable to be engaged to the partition plate device. The support includes a first opening and a second opening. The first opening is used for the support being detachable to be engaged to the partition plate device. The second opening is used for accommodating the lens. Therein, the lens could be an elliptic lens, a circular lens, a cats-eye-like lens, an irregular lens, a polygon lens, or other type of lens (or a set of lenses). According to the preferred embodiment, the lens is a cat's-eye-like lens. The lens includes a surface where a groove is formed along an ellipse minor axis of the lens, such that the light emitted through the lens could form a light pattern satisfying a specific request.

Therefore, the light emitted from the diode light-emitting apparatuses could form an anisotropic light pattern satisfies a specific request, such as road illumination. In a practical application, the light-emitting diode illuminating equipment of the invention could generate a light pattern satisfying the purpose by adjusting and designing the lens for a different purpose.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1A:
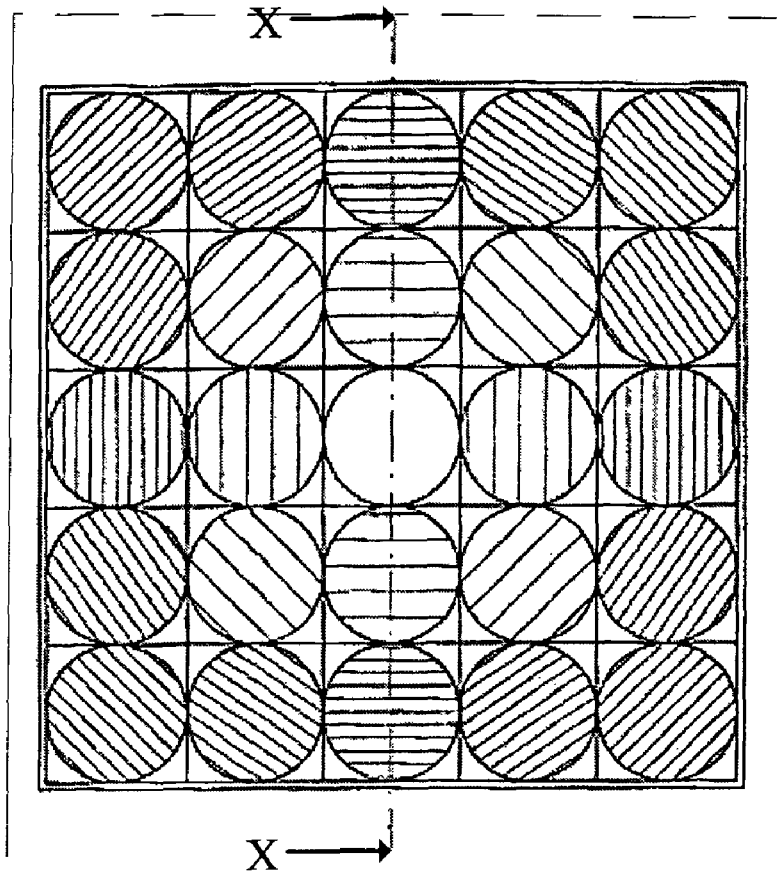
FIG. 1A (prior art)
FIG. 1A is a front view of an illuminating equipment with light-emitting diodes arranged in rows.
Figure 1B:
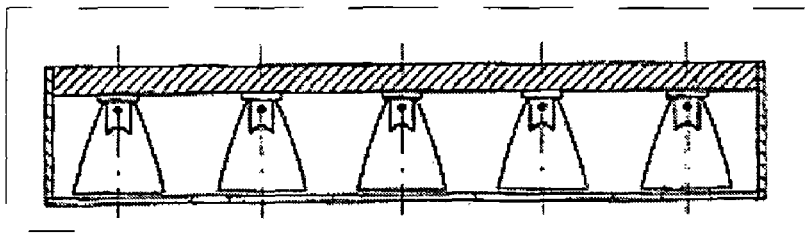
FIG. 1B (prior art)
FIG. 1B is a cross section along the line X-X in FIG. 1A.
Figure 2:
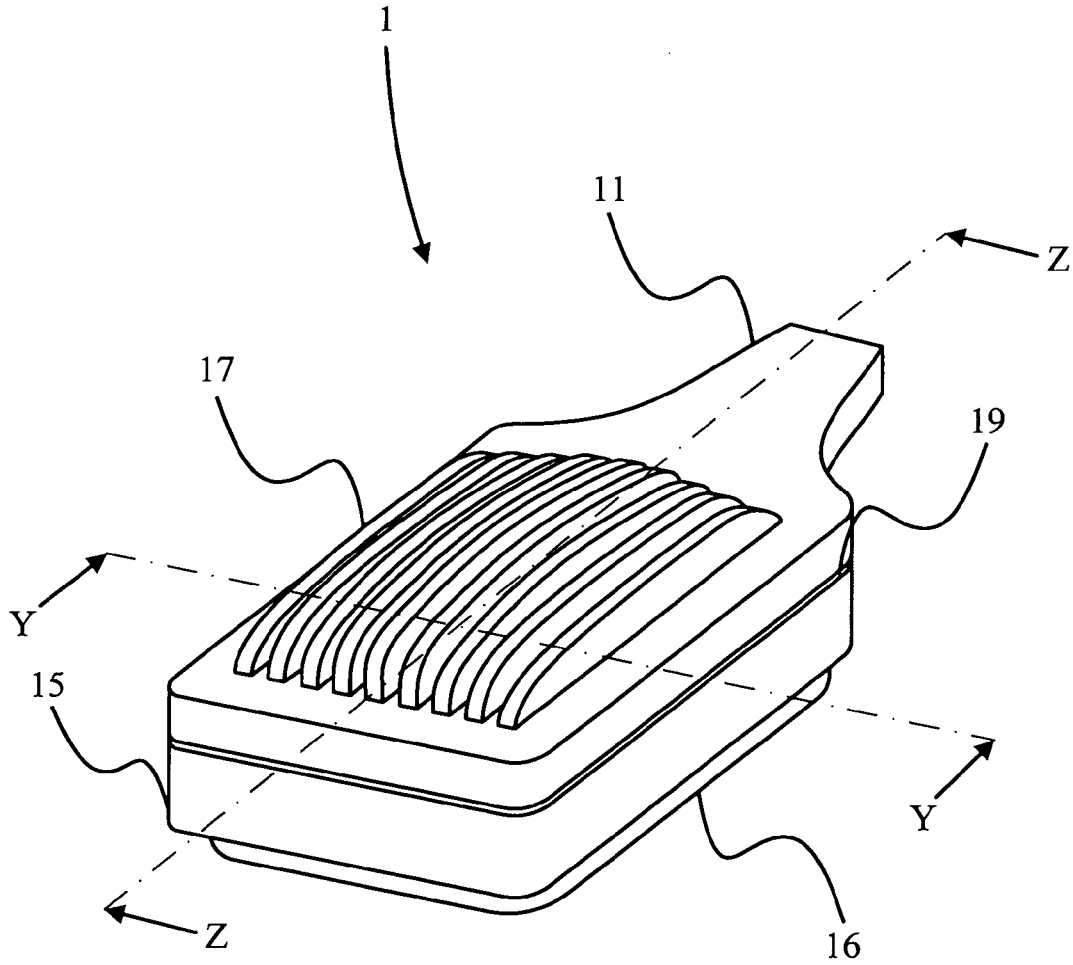
FIG. 2 is an external perspective view of a light-emitting diode illuminating equipment according to a preferred embodiment.
Figure 3A:
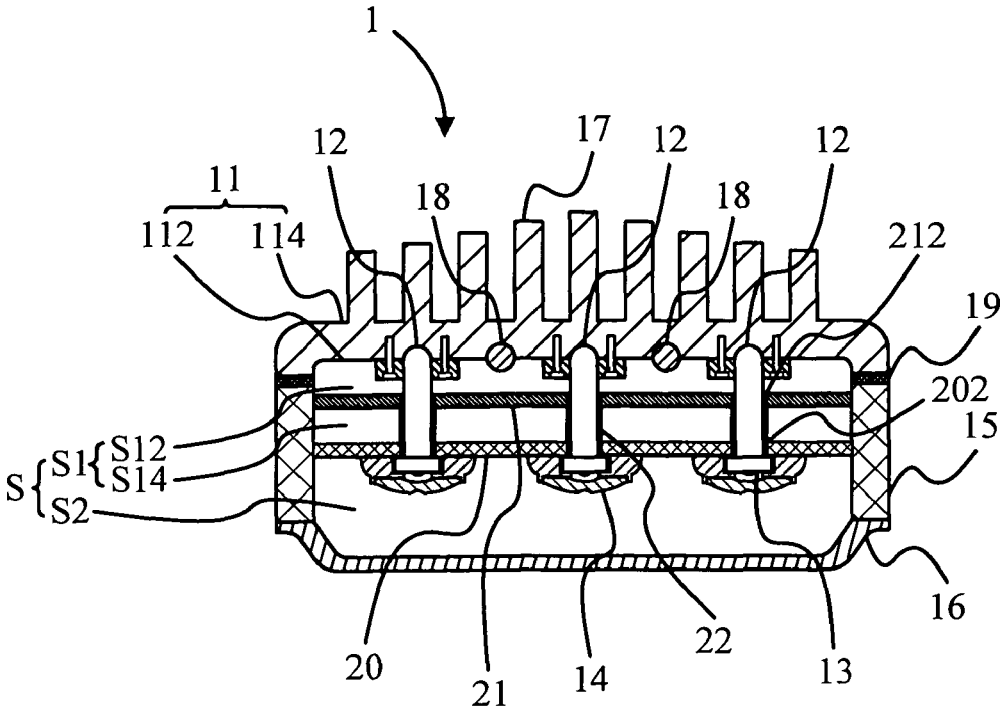
FIG. 3A is a cross section along the line Y-Y in FIG. 2.
Figure 3B:
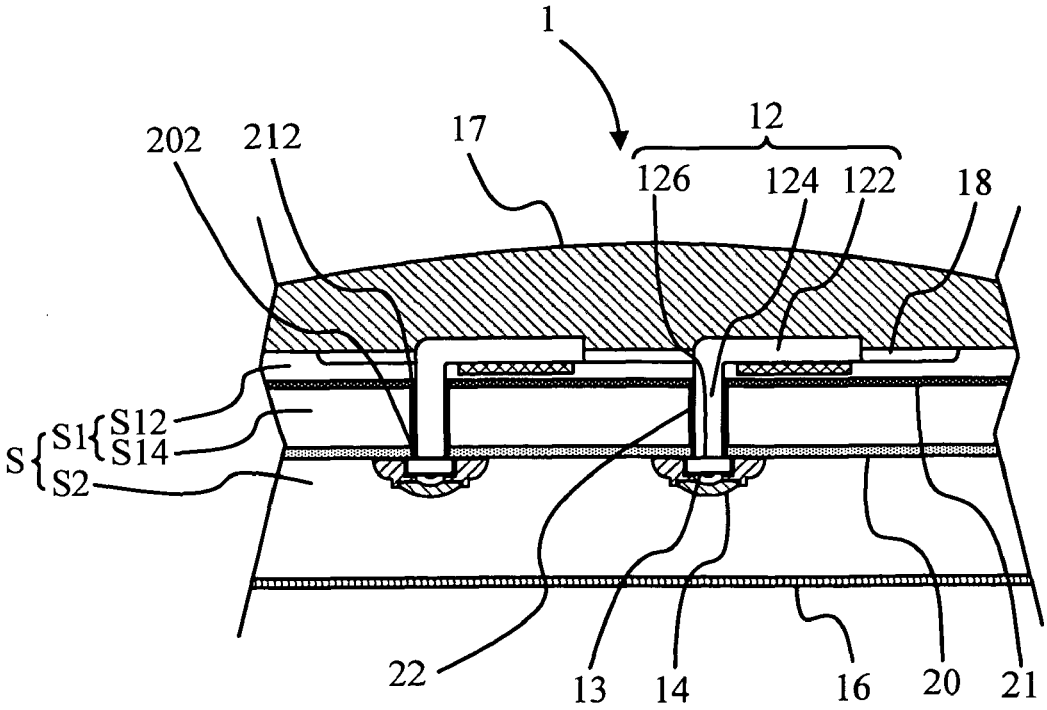
FIG. 3B is a partial cross section along the line Z-Z in FIG. 2.

Please refer to FIGS. 2, 3A, and 3B. FIG. 2 is an external perspective view of a light-emitting diode illuminating equipment 1 according to a preferred embodiment of the invention. FIG. 3A is a cross section along the line Y-Y in FIG. 2. FIG. 3B is a partial cross section along the line Z-Z in FIG. 2.

According to the preferred embodiment, the light-emitting diode illuminating equipment 1 of the invention includes a heat-dissipating plate device 11, six first heat-conducting devices 12, six diode light-emitting apparatuses 13, six optical devices 14, a hollow barrel 15, and a transparent shield 16. The heat-dissipating plate device 11 includes a first surface 112 and a second surface 114 opposite to the first surface 112. A plurality of heat-dissipating fins 17 extend from the second surface 114 and are exposed to the air. Each of the first heat-conducting 12 includes a first portion 122 and a second portion 124 which extends from the first portion 122 and includes a flat end 126.

Each of the diode light-emitting apparatuses 13 corresponds to one of the first heat-conducting devices 12. Each of the diode light-emitting apparatuses 13 is flat mounted on the flat end 126 of the corresponding first heat-conducting device 12 and converts an electric energy into a light. Thereby, heat produced in operation by each of the diode light-emitting apparatus 13 is transferred through the flat end 126, the second portion 124, and the first portion 122 of the corresponding first heat-conducting device 12 to the heat-dissipating plate device 11 and the heat-dissipating fins 17, and then the heat is dissipated out of the heat-dissipating plate device 11 and the heat-dissipating fins 17.

The heat-dissipating plate device 11 of the light-emitting diode illuminating equipment 1 includes six first grooves (not denoted in the figures) formed on the first surface 112 of the heat-dissipating plate device 11. Each of the grooves corresponds to one of the first heat-conducting devices 12, and the shape thereof is adapted to the profile of the first portion 122 of the corresponding first heat-conducting device 12 to tight contact for enhancing the heat-dissipating efficiency. Besides, a heat-conducting material is filled between the first portion 122 of each of the first heat-conducting devices 12 and the corresponding first groove for further enhancing the heat-dissipating efficiency.

In addition, according to the preferred embodiment, the light-emitting diode illuminating equipment 1 includes two second heat-conducting devices 18 tight mounted on the first surface 112 of the heat-dissipating plate device 11 for enhancing the heat-dissipating effect of the heat-dissipating plate device 11 and the heat-dissipating fins 17. As the preferred embodiment shows, the second heat-conducting devices 18 and the first heat-conducting devices 12 are interleaved, which gains a better heat-dissipating effect. Besides, the heat-dissipating plate device 11 includes two second grooves (not denoted in the figures) formed on the first surface 112 of the heat-dissipating plate device 11. Each of the second grooves corresponds to one of the second heat-conducting devices 18, and the shape thereof is adapted to the profile of the corresponding second heat-conducting device 18 to tight contact for enhancing the heat-dissipating efficiency. A heat-conducting material is filled between each of the second heat-conducting devices 18 and the corresponding second groove for further enhancing the heat-dissipating efficiency. Furthermore, the quantity and the configuration of the second heat-conducting devices 18 could be different from the description above, but depends on the whole product structure and operation environment. In principle, the heat-dissipating plate device 11 could gain a good heat-dissipating effect based on the interleaved configuration mentioned above.

Figure 3C:
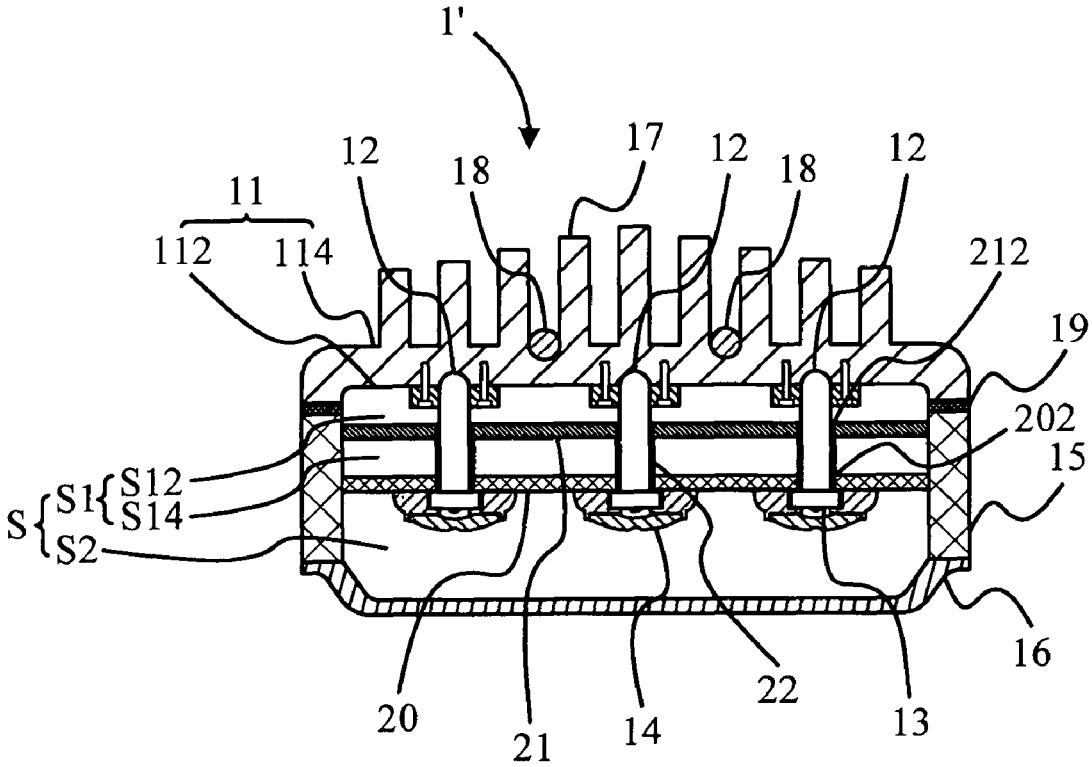
FIG. 3C is a cross section of the light-emitting diode illuminating equipment according to an embodiment.

Please refer to FIG. 3C. FIG. 3C is a cross section of a light-emitting diode illuminating equipment 1' according to an embodiment. The external perspective view of the light-emitting diode illuminating equipment 1' is the same as FIG. 2. FIG. 3C is the cross section along the line Y-Y in FIG. 2. According to the embodiment, the second heat-conducting device 18 of the light-emitting diode illuminating equipment 1' is disposed on the second surface 114 of the heat-dissipating plate device 11. As shown in FIG. 3C, the second heat-conducting devices 18 are disposed between the heat-dissipating fins 17. Based on the same reason, the second surface 114 thereon forms a plurality of grooves adapted for the disposition of the second heat-conducting devices 18, and a heat-conducting material could be filled between the second heat-conducting devices 18 and the grooves for further enhancing the heat-dissipating efficiency. In a practical application, the quantity and the configuration of the second heat-conducting devices 18 are not limited to the description above.

According to the preferred embodiment, each of the optical devices 14 corresponds to one of the diode light-emitting apparatuses 13 for modulating the light pattern of the corresponding diode light-emitting apparatus 13. The hollow barrel 15 is engaged through a circumference thereof to the heat-dissipating plate device 11 to expose the heat-dissipating fins 17 to the air and to form a space S for accommodating the first heat-conducting devices 12 and the diode light-emitting apparatuses 13. The transparent shield 16 is engaged through another circumference of the hollow barrel 15 to seal the space S. But the space S is not necessary to be sealed in the invention. Therein, the hollow barrel 15 is further engaged to the heat-dissipating plate device 11 through a heat-insulating ring 19 so as to reduce or insulate the heat transferred from the heat-dissipating plate device 11 and to make a situation of the light-emitting diode illuminating equipment 1 with top hot and down cold, which is conducive to dissipating heat more.

By the way, the hollow barrel 15 and the transparent shield 16 of the light-emitting diode illuminating equipment 1 of the invention could be made in one piece. For example, the material of the hollow barrel 15 could be engineering plastic, and the transparent shield 16 is inserted in insert molding to make the hollow barrel 15 and the transparent shield 16 in one piece. Alternatively, the material of the transparent shield 16 could also be engineering plastic, and the hollow barrel 15 and the transparent shield 16 could be formed in one piece by injecting in the same die. At this case, if the material of the hollow barrel 15 is the same as the material of the transparent shield 16, the injected product is physically an object which includes the hollow barrel 15 and the transparent shield 16.

According to the preferred embodiment, the light-emitting diode illuminating equipment 1 further includes a partition plate device 20 disposed in the hollow barrel 15 to divide the space S into a first room S1 and a second room S2. The partition plate device 20 thereon forms six first holes 202. Each of the diode light-emitting apparatuses 13 corresponds to one of the first holes 202. According to the preferred embodiment, each of the diode light-emitting apparatuses 13 passes through the corresponding first hole 202 to be disposed in the second room S2 (or in the corresponding first hole 202). The partition plate device 20 could assist in mounting the diode light-emitting apparatuses 13 or the first heat-conducting devices 12. In a practical application, the position of the diode light-emitting apparatuses 13 relative to the partition plate device 20 is not limited to the above.

Figure 4A:
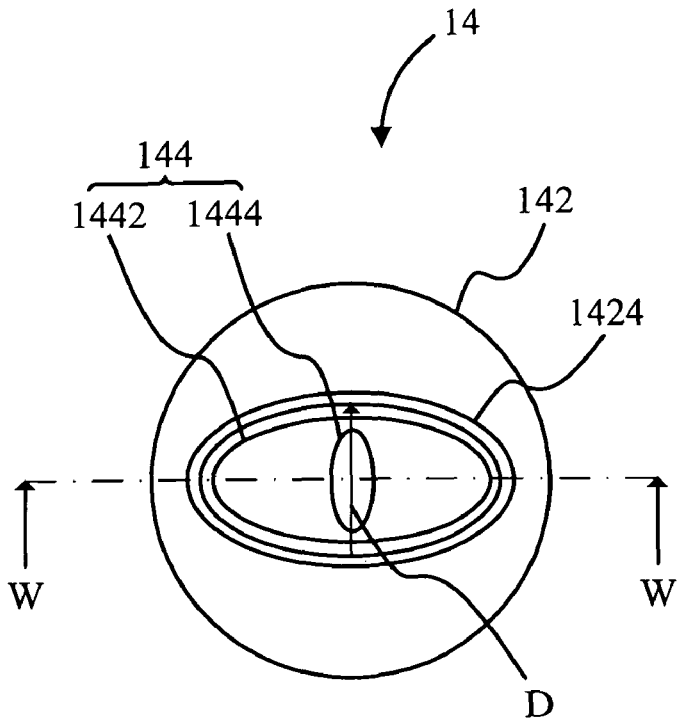
FIG. 4A is a front view of the optical device according to the preferred embodiment.
Figure 4B:
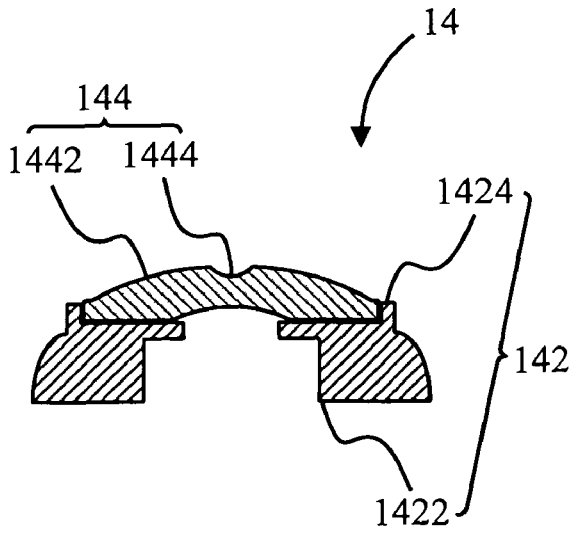
FIG. 4B is a cross section along the line W-W in FIG. 4A.

Please also refer to FIGS. 4A and 4B. FIG. 4A is front view of the optical device 14 according to the preferred embodiment. FIG. 4B is a cross section along the line W-W in FIG. 4A. According to the preferred embodiment, each of the optical devices 14 includes a support 142 and a lens 144. The support 142 is detachable to be engaged to the corresponding diode light-emitting apparatus 13. The support 142 includes a first opening 1422 and a second opening 1424. The first opening 1422 is engaged to the corresponding diode light-emitting apparatus 13, and the second opening 1424 accommodates the lens 144. Therein, the lens 144 could be an elliptic lens, a circular lens, a cat's-eye-like lens, an irregular lens, a polygon lens, or other type of lens (or a set of lenses). According to the preferred embodiment, the lens 144 is a cat's-eye-like lens. The lens 144 includes a surface 1442 thereon defining a direction D. A groove 1444 is formed on the surface 1442 of the lens 144 along the direction D, so that the light emitted through the lens 144 could generate a light pattern satisfying a specific request. According to the preferred embodiment, the direction D is an ellipse minor axis of the lens 144.

Figure 5:
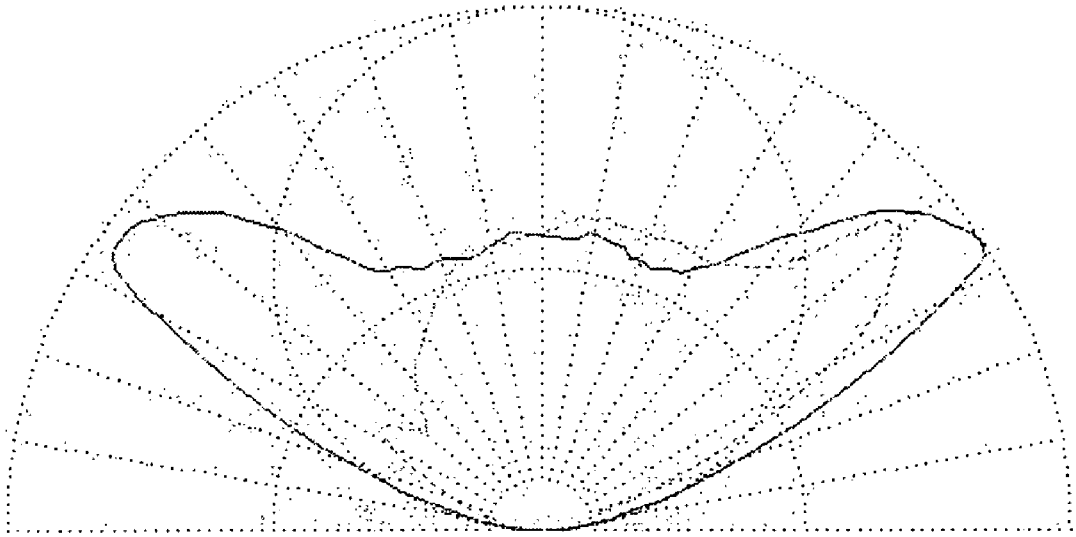
FIG. 5 is a sketch diagram illustrating the light pattern generated according to the preferred embodiment.

Incidentally, please refer to FIG. 5. FIG. 5 is a sketch diagram illustrating the light pattern according to the preferred embodiment. The light pattern is dissymmetrical and also shows that the light-emitting diode illuminating equipment 1 could modulate a circular light pattern into a light pattern with elongation in width, which is conducive to the application of road illumination. In a practical application, for a different purpose, the light-emitting diode illuminating equipment of the invention could generate a light pattern for the purpose by disposing a different lens. In addition, the material of the lens mentioned above is not limited to be homogeneous, and the compound structure is also acceptable in the invention. For example, the index of refraction of the center portion of the lens is smaller than that of the peripheral portion, or the index of refraction of the lens varies continuously, such that the brightness within the light pattern is uniform. Furthermore, there is a light-emitting diode package that the packing material is formed directly with a protuberance as a simple positive lens. There is also a package that a positive lens covers directly after packing to achieve the effect of light concentration. However, the above packages can not form a required light pattern. On the contrary, the light-emitting diode illuminating equipment of the invention could generate a required light pattern even with the light-emitting diodes packed by the above two packages.

Figure 6:
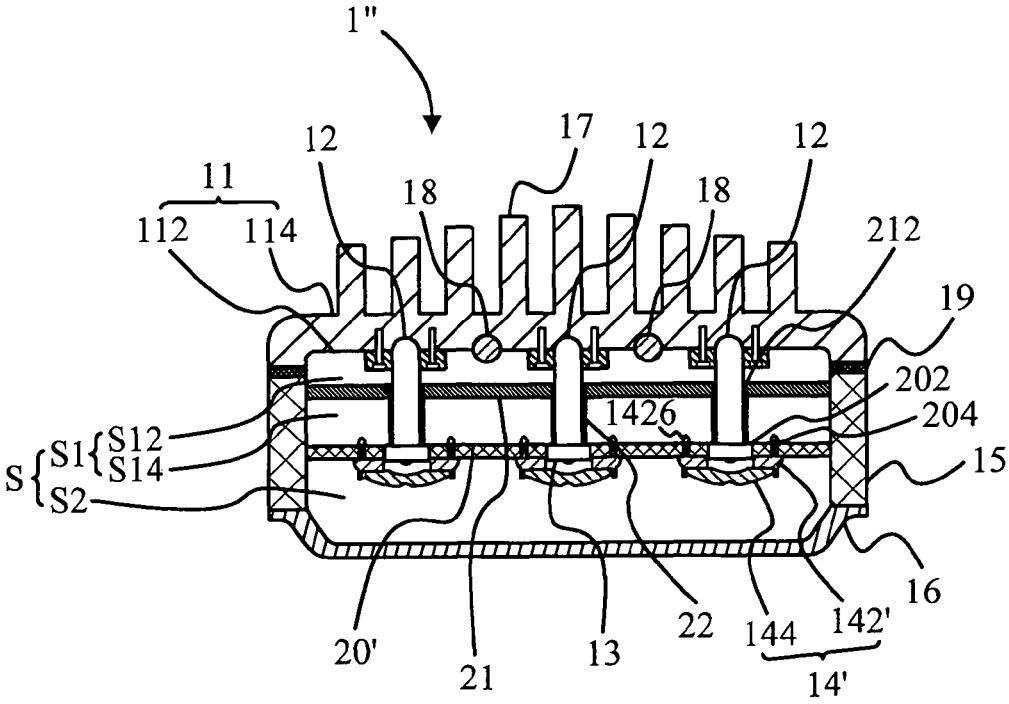
FIG. 6 is a cross section of the light-emitting diode illuminating equipment according to an embodiment.

Please refer to FIG. 6. FIG. 6 is a cross section of a light-emitting diode illuminating equipment 1" according to an embodiment. Compared with the preferred embodiment, the partition plate device 20' of the light-emitting diode illuminating equipment 1" forms a plurality of holes 204 around each of the first holes 202, and the first opening of the support 142' of each of the optical devices 14' includes a plurality of hooks 1426. The hooks 1426 are inserted into the holes 204 so that the support 142' is engaged to the partition plate device 20'.

Figure 7:
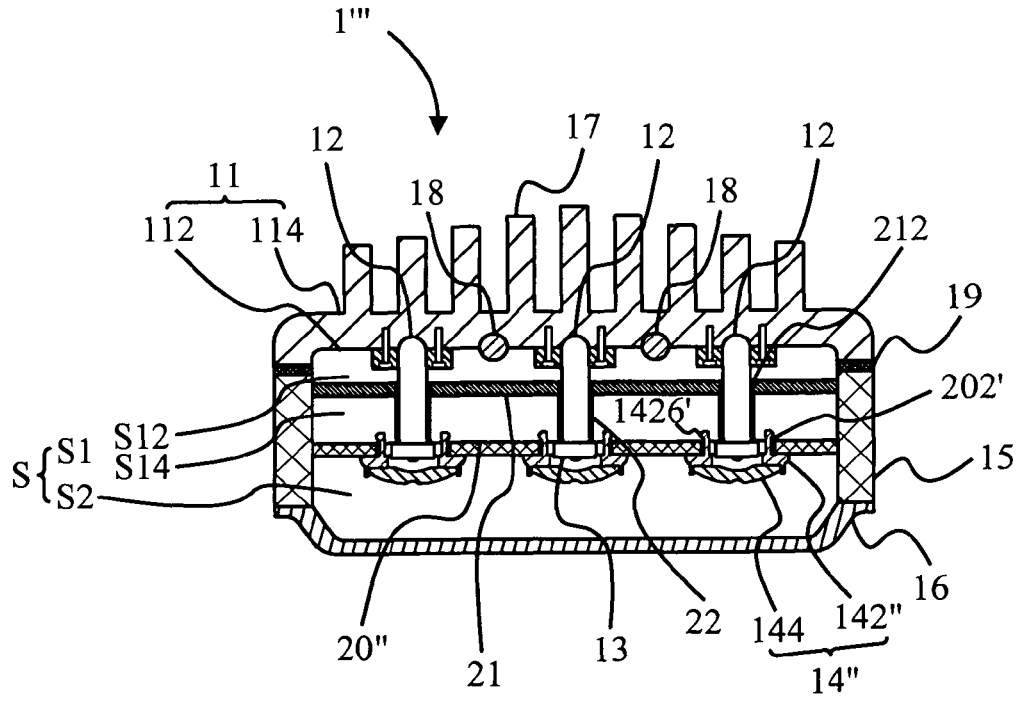
FIG. 7 is a cross section of the light-emitting diode illuminating equipment according to another embodiment.

Please refer to FIG. 7. FIG. 7 is a cross section of a light-emitting diode illuminating equipment 1'" according to another embodiment. Compared with the preferred embodiment, the first opening of the support 142" of each of the optical devices 14" of the light-emitting diode illuminating equipment 1'" includes a plurality of hooks 1426'. The hooks 1426' are inserted into the corresponding first hole 202' so that the support 142" is engaged to the partition plate device 20". It is noticed that for the engagement of the support 142" and the partition plate device 20" of the light-emitting diode illuminating equipment 1'" of the invention, the hooks could be designed to formed on the partition plate device, and the holes could be designed to formed on the support accordingly, which still achieves the purpose of detachable engagement. In addition, the engagement could be made by screwing with screws.

According to the preferred embodiment, the light-emitting diode illuminating equipment 1 further includes a heat-insulating plate device 21 disposed in the first room S1 to divide the first room S1 into a third room S12 and a fourth room S14. The heat-insulating plate device 21 thereon forms six second holes 212. The second portion 124 of each of the first heat-conducting devices 12 corresponds to one of the second holes 212 and passes through the corresponding second hole 212, as shown in FIG. 3A. Therefore, because of the insulation of the heat-insulating plate device 21, the heat transferred to the heat-dissipating plate device 11 could not radiate or be conducted to the fourth room S14 to avoid a heat impact of the heat to the diode light-emitting apparatuses 13. Furthermore, a gap between the first heat-conducting devices 12 and the second holes 212 could be filled with a heat-insulating material to enhancing the heat-insulating effect. In addition, the light-emitting diode illuminating equipment 1 further includes a heat-insulating sleeve 22. The sleeve 22 covers the second portion 124 of one of the first heat-conducting devices 12, especially the second portion 124 in the fourth room S14, so that the heat generated in operation by the diode light-emitting apparatus 13 corresponding to the first heat-conducting device 12 could not dissipate into the fourth room S14 so as to enhancing the heat-dissipating efficiency of the heat-dissipating plate device 11. It is noticed that if the partition plate device 20 has the function of heat insulation, the heat-insulating plate device 21 could be omitted to simplify the structure design. The above structure description could also be applied to the above embodiments, as shown in FIGS. 6 and 7.

Figure 8A:
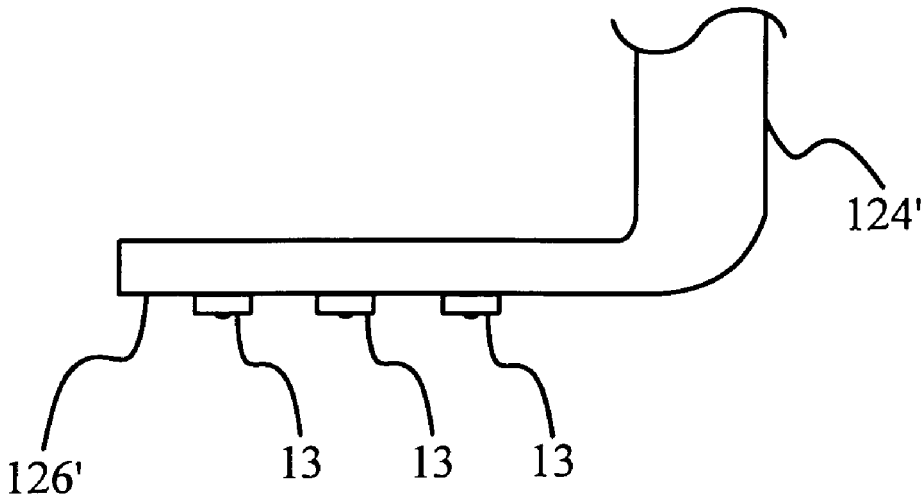
FIG. 8A is a sketch diagram illustrating the configuration of the diode light-emitting apparatuses and the first heat-conducting device of the light-emitting diode illuminating equipment.
Figure 8B:
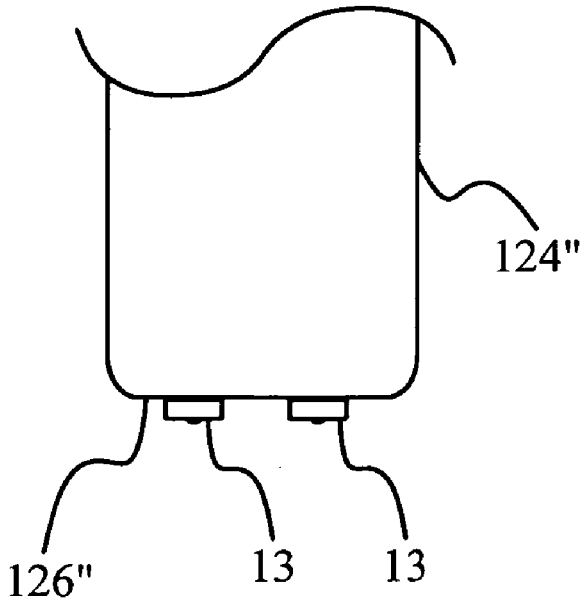
FIG. 8B is another sketch diagram illustrating the configuration of the diode light-emitting apparatuses and the first heat-conducting device of the light-emitting diode illuminating equipment.

It is noticed that each of the first heat-conducting devices 12 of the light-emitting diode illuminating equipment 1 according to the preferred embodiment corresponds to one of the diode light-emitting apparatuses 13, but the invention is not limited to this. For example, several of the diode light-emitting apparatuses 13 are disposed on the flat end 126' of one of the heat-conducting devices 12. At this case, the flat end 126' may be formed by pressing the second portion 124' for allowing the several diode light-emitting apparatuses 13 disposed thereon, as shown in FIG. 8A. It is possible that the diameter of the second portion 124" of the heat-conducting device 12 is large enough so that the flat end 126" is larger accordingly to allow several of the diode light-emitting apparatuses 13 disposed thereon, as shown in FIG. 8B. It is noticed that the partition plate device and the optical device are not shown in FIGS. 8A and 8B to clearly show the structure relation of the diode light-emitting apparatus 13 and the heat-conducting device 12.

Figure 9A:
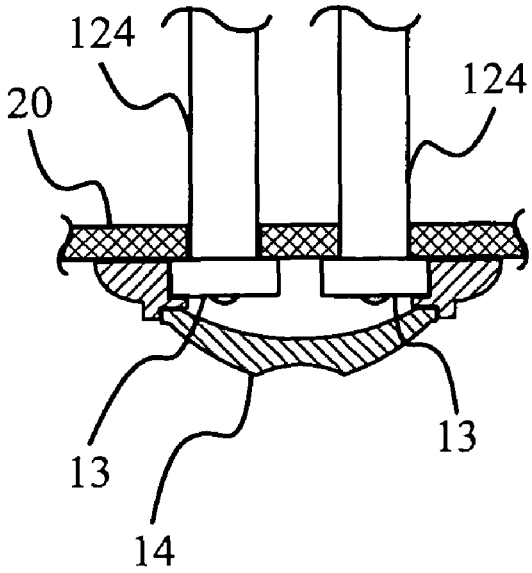
FIG. 9A is a sketch diagram illustrating the corresponding relation of the diode light-emitting apparatuses and the optical device.
Figure 9B:
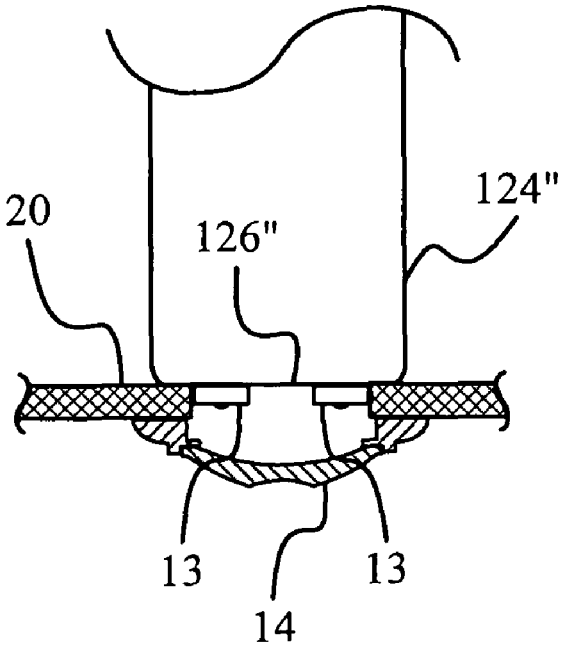
FIG. 9B is another sketch diagram illustrating the corresponding relation of the diode light-emitting apparatuses and the optical device.

Similarly, each of the optical devices 14 is not limited to correspond to only one of the diode light-emitting apparatuses 13. One of the optical devices 14 could correspond to several of the diode light-emitting apparatuses 13 and the lens 144 of the optical device 14 could concurrently modulate the light pattern of the corresponding diode light-emitting apparatus 13. The fore-mentioned description about the engagement structure of the optical devices 14 is also applied to here. For example, when one of the optical devices 14 is engaged to the partition plate device 20, the optical device 14 covers several of the diode light-emitting apparatuses 13, as shown in FIG. 9A. The several diode light-emitting apparatuses 13 could be disposed at the same flat end 126, as shown in FIG. 9B. In an extreme case, the light-emitting diode illuminating equipment of the invention includes only one optical device which corresponds to all of the diode light-emitting apparatuses and modulates the light pattern of all of the diode light-emitting apparatuses. At this case, in fact the optical device can be integrated with the transparent shield, even also with the hollow barrel to be a single component. The lens design of the optical device will be more complicated though. Therefore, the corresponding relation of the optical devices 14 and the diode light-emitting apparatuses 13 may be various and will not be described in detail here.

In addition, the corresponding relation of the first holes 202 of the partition plate device 20 and the diode light-emitting apparatuses 13 is also various as the above. For example, one of the first holes 202 corresponds to several of the diode light-emitting apparatuses 13. The corresponding diode light-emitting apparatuses 13 may be disposed on the same first heat-conducting device 12 or on different first heat-conducting devices 12. Furthermore, the shape of the first hole 202 is not limited to be circular, but depends on the actual design. For example, the first hole 202 may correspond to several of the diode light-emitting apparatuses 13, and the disposition of the several diode light-emitting apparatuses 13 and the first heat-conducting device 12 is similar to that in FIG. 8A. At this case, the first hole 202 may be an ellipse. Therefore, the possible geometrical structure of the diode light-emitting apparatuses, the first heat-conducting devices, and the optical devices of the light-emitting diode illuminating equipment of the invention is various, and is not limited to the above descriptions and embodiments.

By the way, the above descriptions are based on the same lens. However, in a practical application, the diode light-emitting apparatuses could correspond to different lenses respectively, or a part of the diode light-emitting apparatuses corresponds to the same lens and the other part of the diode light-emitting apparatuses corresponds to different lenses, so as to gain diversified light patterns. In addition, in the above embodiments, the first heat-conducting devices 12 or the second heat-conducting devices 18 respectively could be a heat pipe, a heat column, a vapor chamber, or other heat-conducting device. The first heat-conducting devices 12 or the second heat-conducting devices 18 respectively could be made of copper, aluminum, or other material with high heat-conducting efficiency. One of the diode light-emitting apparatuses 13 includes at least one light-emitting diode or at least one laser diode. Besides, the light-emitting apparatus 13 could include light-emitting diodes of different colors.

As described above, the light-emitting diode illuminating equipment of the invention is designed with secondary optics and adjusts the optical devices to generate light patterns of the light emitted from the diode light-emitting apparatuses to satisfy different purposes. Besides, the light-emitting diode illuminating equipment could generate various light patterns by adjusting and designing the optical devices to satisfy more diversified purposes. It is noticed that the above embodiments are based on a street light, but the invention is not limited to this. The invention is applied for any request of illumination, especially the request for a specific light pattern.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A light-emitting diode illuminating equipment, comprising:

a heat-dissipating plate device comprising a first surface;

M first heat-conducting devices, each of the first heat-conducting devices comprising a first portion and a second portion comprising a flat area, the first portion being mounted on the first surface of the heat-dissipating plate device, M being a natural number;

N diode light-emitting apparatuses, each of the diode light-emitting apparatuses being disposed on the flat area of one of the first heat-conducting devices and converting an electric energy into a light, N being a natural number, N being larger or equal to M;

P optical devices, each of the optical devices corresponding to at least one of the diode light-emitting apparatuses for modulating a light pattern of the corresponding diode light-emitting apparatus, P being a natural number, P being smaller or equal to N;

a hollow barrel comprising a first circumference, the hollow barrel being engaged through the first circumference to the heat-dissipating plate device to form a space for accommodating the first heat-conducting devices and the diode light-emitting apparatuses; and a heat-insulating ring;

wherein the hollow barrel is engaged through the heat-insulating ring to the heat-dissipating plate device.

2. The light-emitting diode illuminating equipment of claim 1, wherein each of the optical devices comprises a support and a lens, and the support is detachable to be engaged to the corresponding diode light-emitting apparatus.

3. The light-emitting diode illuminating equipment of claim 2, wherein the support comprises a first opening and a second opening, the first opening is engaged to the corresponding diode light-emitting apparatus, and the second opening accommodates the lens.

4. The light-emitting diode illuminating equipment of claim 3, wherein the lens is one selected from the group consisting of an elliptic lens, a circular lens, a cat's-eye-like lens, an irregular lens, and a polygon lens.

5. The light-emitting diode illuminating equipment of claim 4, wherein the P optical devices comprise a first optical device and a second optical device, and the lens of the first optical device is the same as the lens of the second optical device.

6. The light-emitting diode illuminating equipment of claim 4, wherein the P optical devices comprise a first optical device and a second optical device, and the lens of the first optical device is different from the lens of the second optical device.

7. The light-emitting diode illuminating equipment of claim 1, further comprising a partition plate device, the partition plate device being disposed in the hollow barrel to divide the space into a first room and a second room, the partition plate device comprising Q first holes thereon, each of the diode light-emitting apparatuses corresponding to one of the first holes, Q being a natural number, Q being smaller or equal to N.

8. The light-emitting diode illuminating equipment of claim 7, wherein each of the optical devices comprises a support and a lens, and the support is detachable to be engaged to the partition plate device.

9. The light-emitting diode illuminating equipment of claim 8, wherein the support comprises a first opening and a second opening, the first opening is detachable to be engaged to the partition plate device, and the second opening accommodates the lens.

10. The light-emitting diode illuminating equipment of claim 8, wherein the lens is one selected from the group consisting of an elliptic lens, a circular lens, a cat's-eye-like lens, an irregular lens, and a polygon lens.

11. The light-emitting diode illuminating equipment of claim 10, wherein the cat's-eye-like lens comprises a surface, the surface thereon defines a direction, and a groove is formed along the direction on the surface.

12. The light-emitting diode illuminating equipment of claim 11, wherein the direction is an ellipse minor axis of the lens.

13. The light-emitting diode illuminating equipment of claim 7, wherein the partition plate device is capable of insulating heat.

14. The light-emitting diode illuminating equipment of claim 7, further comprising a heat-insulating plate device disposed in the first room, the heat-insulating plate device comprising M second holes thereon, the second portion of each of the first heat-conducting devices corresponding to one of the second holes and passing through the corresponding second hole.

15. The light-emitting diode illuminating equipment of claim 14, further comprising a heat-insulating sleeve, the heat-insulating sleeve covering the second portion of one of the first heat-conducting devices.

16. The light-emitting diode illuminating equipment of claim 1, wherein the heat-dissipating plate device comprises M first grooves formed on the first surface of the heat-dissipating plate device, and the first portion of each of the first heat-conducting devices is mounted on corresponding one of the first grooves.

17. The light-emitting diode illuminating equipment of claim 16, wherein a heat-conducting material is filled between the first portion of each of the first heat-conducting devices and the corresponding first groove.

18. The light-emitting diode illuminating equipment of claim 1, further comprising a plurality of heat-dissipating fins, wherein the heat-dissipating plate device comprises a second surface opposite to the first surface, and the heat-dissipating fins extend from the second surface and are exposed to air.

19. The light-emitting diode illuminating equipment of claim 18, further comprising a plurality of second heat-conducting devices mounted on the second surface of the heat-dissipating plate device.

20. The light-emitting diode illuminating equipment of claim 1, further comprising a plurality of second heat-conducting devices mounted on the first surface of the heat-dissipating plate device.

21. The light-emitting diode illuminating equipment of claim 20, wherein the heat-dissipating plate device comprises a plurality of second grooves formed on the first surface of the heat-dissipating plate device, and each of the second heat-conducting devices is mounted on corresponding one of the second grooves.

22. The light-emitting diode illuminating equipment of claim 21, wherein a heat-conducting material is filled between each of the second heat-conducting devices and the corresponding second groove.

23. The light-emitting diode illuminating equipment of claim 1, further comprising a transparent shield, wherein the hollow barrel comprises a second circumference, the transparent shield is engaged to the second circumference of the hollow barrel.

24. The light-emitting diode illuminating equipment of claim 1, wherein the flat area of the second portion of each of the first heat-conducting devices is at an end of the first heat-conducting device.

25. A light-emitting diode illuminating equipment, comprising:

a heat-dissipating plate device comprising a first surface;

M first heat-conducting devices, each of the first heat-conducting devices comprising a first portion and a second portion comprising a flat area, the first portion being mounted on the first surface of the heat-dissipating plate device, M being a natural number;

N diode light-emitting apparatuses, each of the diode light-emitting apparatuses being disposed on the flat area of one of the first heat-conducting devices and converting an electric energy into a light, N being a natural number, N being larger or equal to M;

P optical devices, each of the optical devices corresponding to at least one of the diode light-emitting apparatuses for modulating a light pattern of the corresponding diode light-emitting apparatus, P being a natural number, P being smaller or equal to N; and a hollow barrel comprising a first circumference, the hollow barrel being engaged through the first circumference to the heat-dissipating plate device to form a space for accommodating the first heat-conducting devices and the diode light-emitting apparatuses, wherein each of the optical devices comprises a support and a lens, and the support is detachable to be engaged to the corresponding diode light-emitting apparatus, and the P optical devices comprise a first optical device and a second optical device, and the lens of the first optical device is the same as the lens of the second optical device.

26. A light-emitting diode illuminating equipment, comprising:

a heat-dissipating plate device comprising a first surface;

M first heat-conducting devices, each of the first heat-conducting devices comprising a first portion and a second portion comprising a flat area, the first portion being mounted on the first surface of the heat-dissipating plate device, M being a natural number;

N diode light-emitting apparatuses, each of the diode light-emitting apparatuses being disposed on the flat area of one of the first heat-conducting devices and converting an electric energy into a light, N being a natural number, N being larger or equal to M;

P optical devices, each of the optical devices corresponding to at least one of the diode light-emitting apparatuses for modulating a light pattern of the corresponding diode light-emitting apparatus, P being a natural number, P being smaller or equal to N; and a hollow barrel comprising a first circumference, the hollow barrel being engaged through the first circumference to the heat-dissipating plate device to form a space for accommodating the first heat-conducting devices and the diode light-emitting apparatuses, wherein the heat-dissipating plate device comprises M first grooves formed on the first surface of the heat-dissipating plate device, and the first portion of each of the first heat-conducting devices is mounted on corresponding one of the first grooves.

* * * * *